US006681456B1

(12) United States Patent
Dischler

(10) Patent No.: US 6,681,456 B1
(45) Date of Patent: Jan. 27, 2004

(54) ZIPPER STRINGER HAVING COUPLING ELEMENTS WITH VARIABLE PROPERTIES

(75) Inventor: Louis Dischler, Spartanburg, SC (US)

(73) Assignee: Delphi Oracle Corp., Spartanburg, SC (US)

( * ) Notice: Subject to any disclaimer, the term of this patent is extended or adjusted under 35 U.S.C. 154(b) by 0 days.

(21) Appl. No.: 10/217,373

(22) Filed: Aug. 13, 2002

Related U.S. Application Data

(63) Continuation-in-part of application No. 09/803,332, filed on Mar. 8, 2001, now Pat. No. 6,453,521.

(51) Int. Cl.[7] ..... A44B 19/02
(52) U.S. Cl. ..... 24/406; 24/403
(58) Field of Search ..... 24/33 A, 33 B, 24/33 C, 33 F, 33 K, 33 L, 33 M, 33 P, 33 R, 33 V, 391–414, 585.1–585.12, 589.1

(56) References Cited

U.S. PATENT DOCUMENTS

| | | | | | |
|---|---|---|---|---|---|
| 1,015,783 | A | | 1/1912 | Conn | |
| 1,219,881 | A | | 3/1917 | Sundback | |
| 2,095,270 | A | | 10/1937 | Silberman | |
| 2,394,211 | A | | 2/1946 | Siff | |
| 2,578,422 | A | | 12/1951 | Morin | |
| 2,701,401 | A | | 2/1955 | Dorman | |
| 2,828,523 | A | * | 4/1958 | Morin | 24/406 |
| 2,912,732 | A | | 11/1959 | Stolz et al. | |
| 3,540,090 | A | | 11/1970 | Takamatsu | |
| 3,735,451 | A | | 5/1973 | Haythornthwaite | |
| 3,903,572 | A | * | 9/1975 | Takagi | 24/401 |
| 3,977,051 | A | | 8/1976 | Takamatsu | |
| 4,000,545 | A | | 1/1977 | Takamatsu | |
| 4,040,150 | A | | 8/1977 | Fukuroi | |
| 4,137,034 | A | | 1/1979 | Moertel | |
| D252,896 | S | | 9/1979 | Jovin | |
| 4,182,600 | A | | 1/1980 | Moertel | |
| 4,268,474 | A | | 5/1981 | Moertel | |
| 4,308,645 | A | | 1/1982 | Hasegawa | |
| 4,309,798 | A | * | 1/1982 | Fraga | 24/405 |
| 4,350,656 | A | | 9/1982 | Moertel | |
| 4,418,449 | A | | 12/1983 | Heimberger et al. | |
| 4,611,367 | A | | 9/1986 | Meulenberg et al. | |
| 4,713,946 | A | * | 12/1987 | Hoerkens | 63/4 |
| 4,922,585 | A | * | 5/1990 | Suzuki et al. | 24/381 |
| 4,987,658 | A | * | 1/1991 | Horita | 24/403 |
| 5,327,823 | A | | 7/1994 | Clevenger, Jr. et al. | |
| 5,956,818 | A | * | 9/1999 | Tsubata | 24/397 |
| 5,983,465 | A | * | 11/1999 | Wakai et al. | 24/392 |
| 6,182,338 | B1 | * | 2/2001 | Watanabe | 24/697.1 |
| 6,279,209 | B1 | * | 8/2001 | Kang | 24/403 |

FOREIGN PATENT DOCUMENTS

| | | | |
|---|---|---|---|
| EP | 0 330 171 | * | 8/1989 |

OTHER PUBLICATIONS

U.S. patent application Ser. No. 09/803,332, Dischler, filed Sep. 2002.

* cited by examiner

*Primary Examiner*—Robert J. Sandy
*Assistant Examiner*—Ruth C. Rodriguez

(57) ABSTRACT

A zipper is provided wherein at least one stringer has a row of coupling elements presenting a variable visual appearance along the coupled length of the zipper. The zipper has improved aural, tactile or visual aesthetics, and is more difficult to counterfeit.

24 Claims, 13 Drawing Sheets

FIG. 1
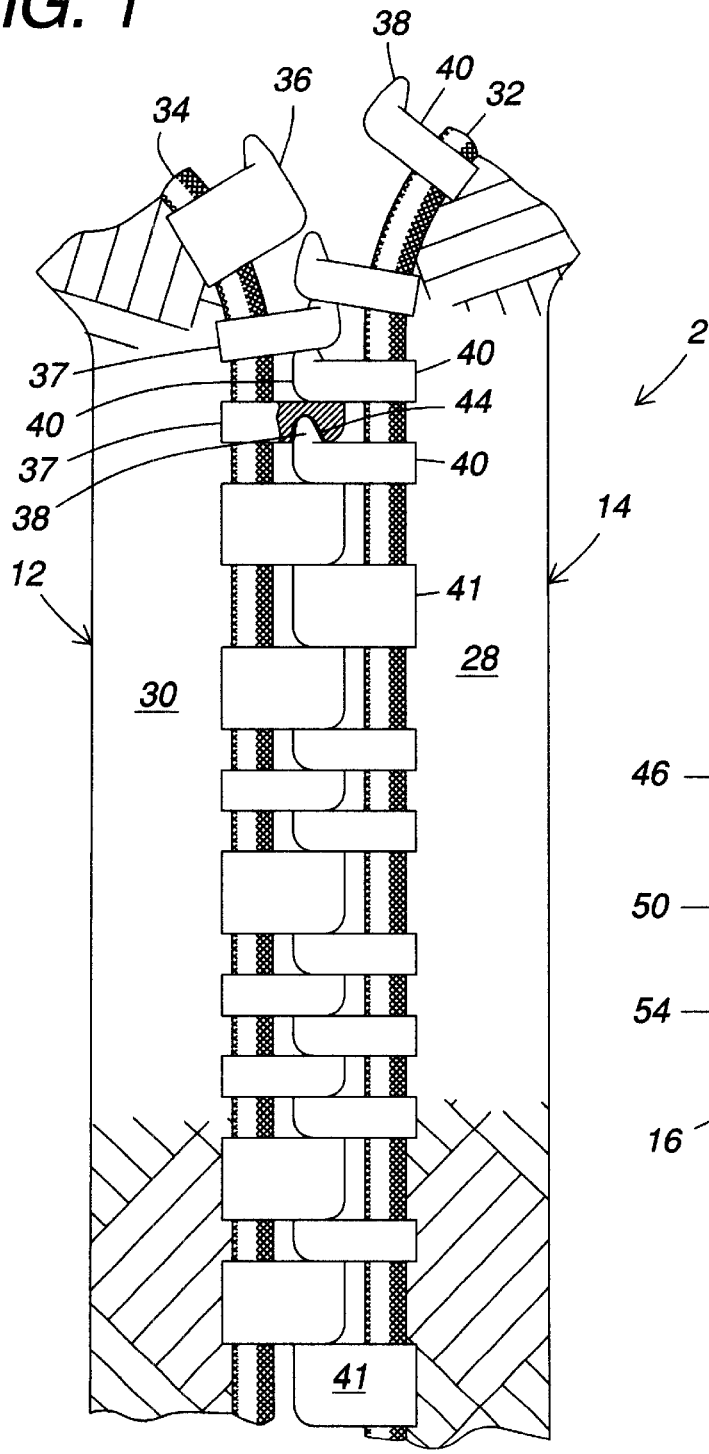
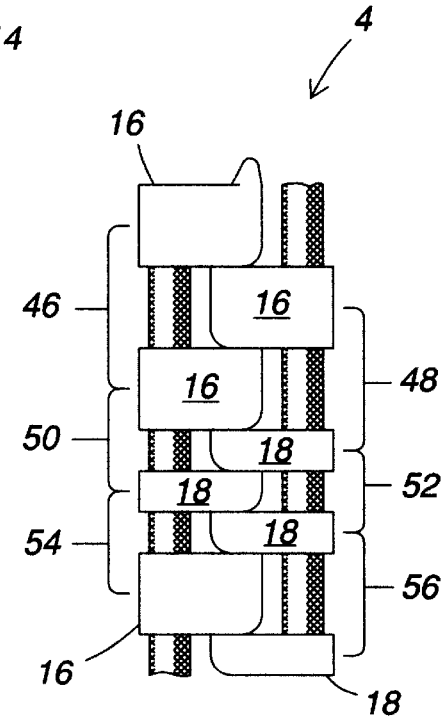
FIG. 2

FIG. 3
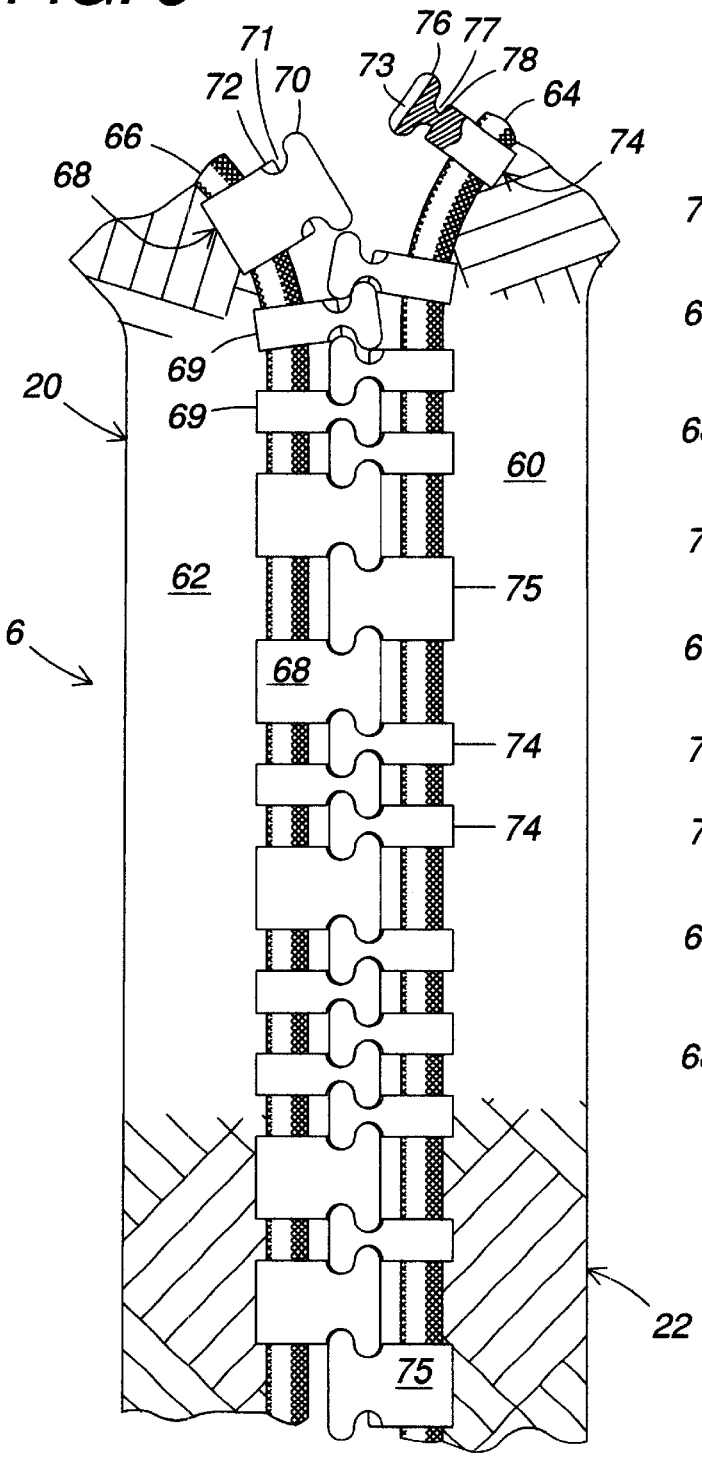
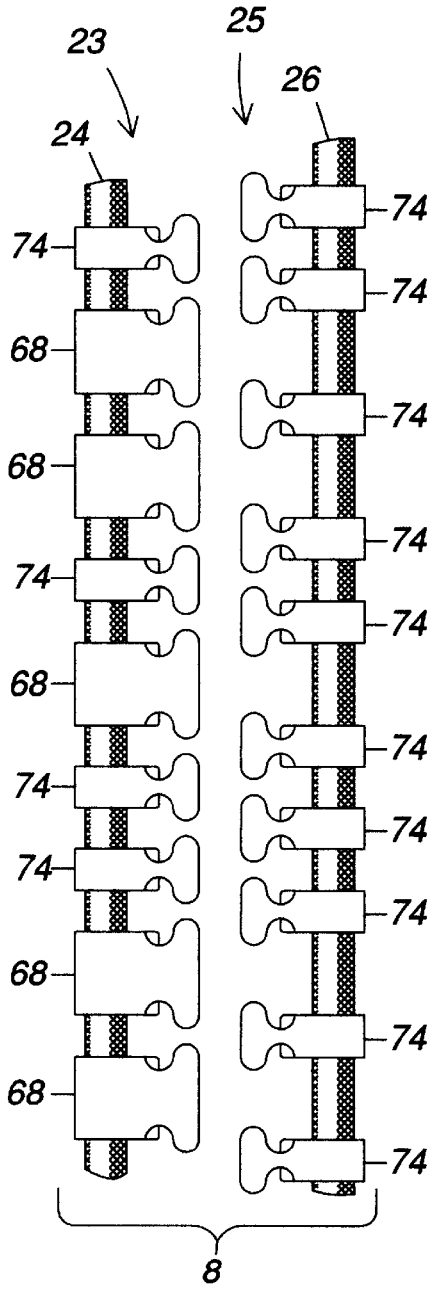
FIG. 4

FIG. 8A
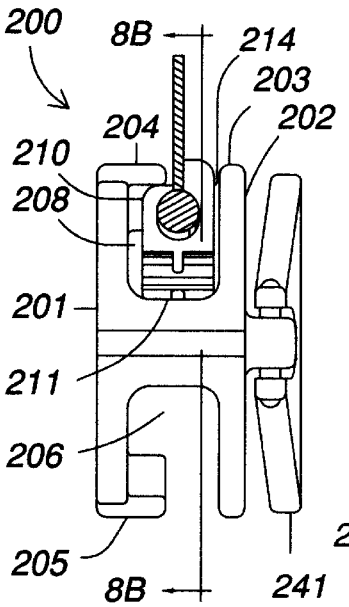
FIG. 8B
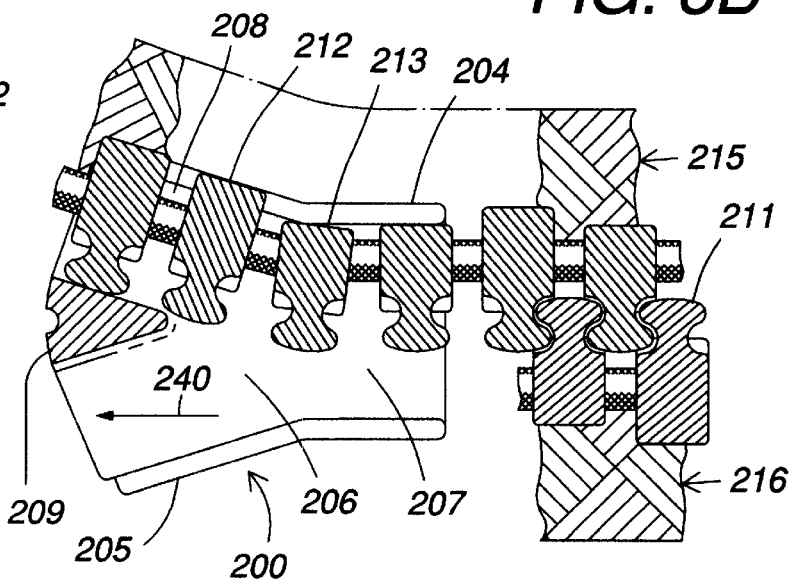
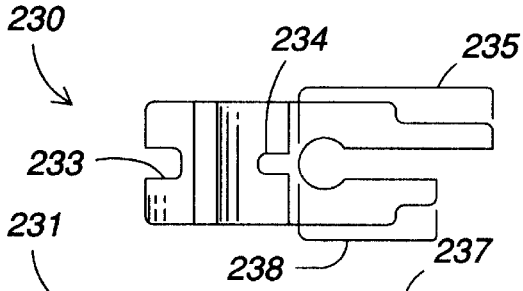
FIG. 9A
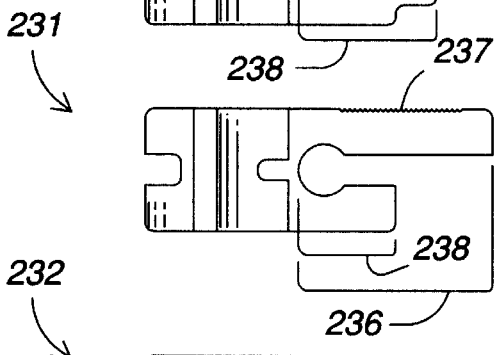
FIG. 9B
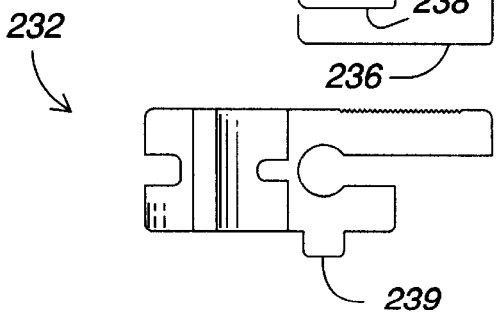
FIG. 9C FIG. 10A
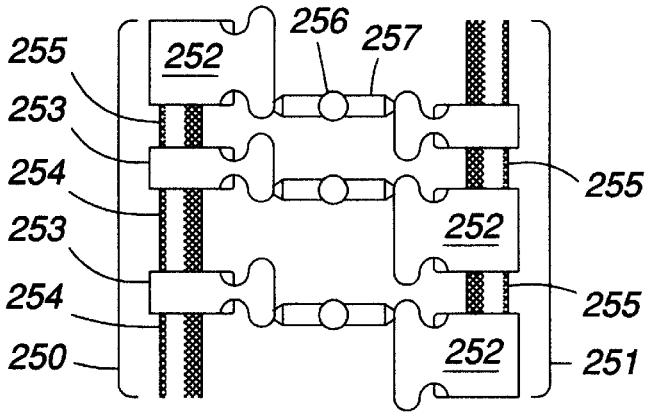
FIG. 10B
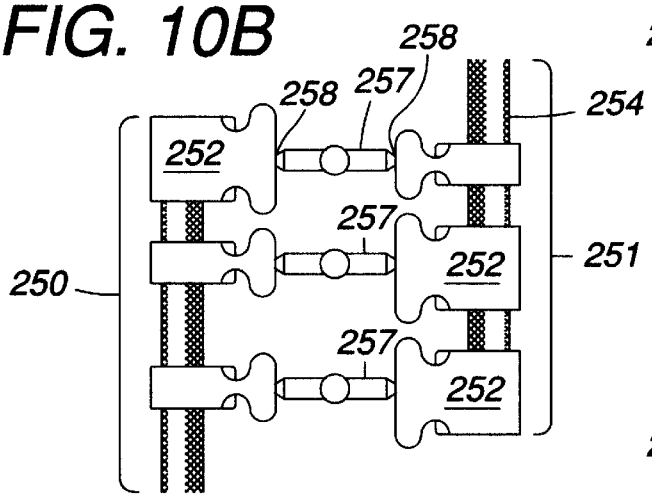
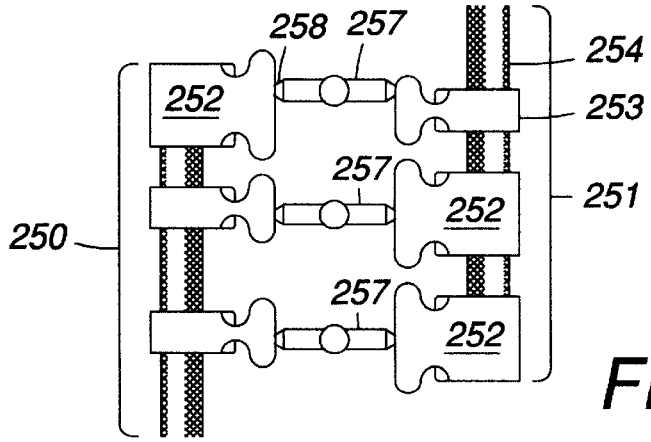
FIG. 10C
FIG. 11
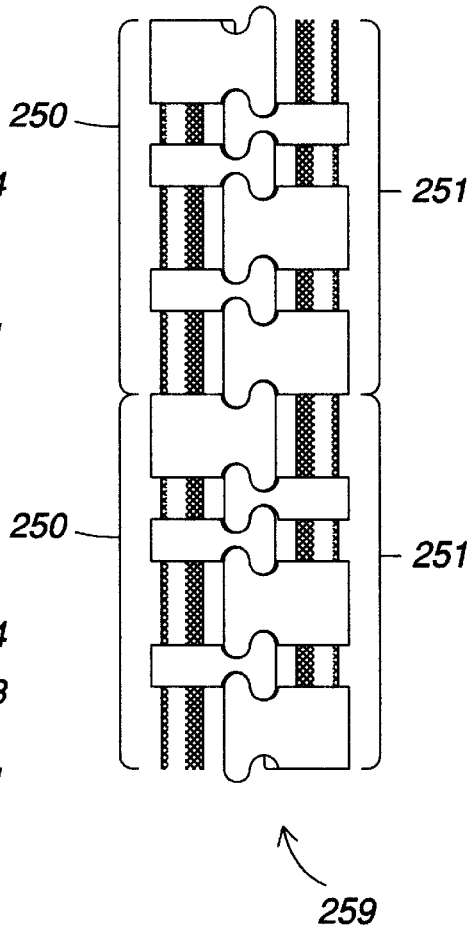

ZIPPER STRINGER HAVING COUPLING ELEMENTS WITH VARIABLE PROPERTIES

This application is a continuation-in-part of U.S. application Ser. No. 09/803,332, entitled "Multiple Pitch Zipper", filed in the U.S. Patent and Trademark Office on Mar. 8, 2001 now U.S. Pat. No. 6,453,521. All cited applications/patents are incorporated by reference in their entirety for all purposes.

FIELD OF THE INVENTION

This invention relates to sliding fasteners, and more particularly to zippers having interlocking coupling elements alternately attached to separate stringers, wherein the coupling elements present a varying visual effect along the length of at least one stringer. The zipper may carry coded information or a trademarked sequence to discourage counterfeiting.

BACKGROUND OF THE INVENTION

While the major function of a zipper assembly is mechanical—to reversibly couple two generally flexible panels or strips, aesthetic considerations also arise which may dictate when and how a zipper may be used in a given application. The aesthetic considerations may be aural, tactile and/or visual. The present invention alters the visual aspect of the zipper assembly to provide a less mechanical appearance, and may also alter the sound and feel of the zipper when it is opened and closed.

SUMMARY OF THE INVENTION

The present invention provides for a zipper stringer or zipper assembly comprising two stringers. At least one stringer has a row of coupling elements presenting a variable visual appearance along the coupled length of the zipper. The variable visual effect may be achieved by varying E* for a plurality of pairs of adjacent coupling elements, i.e., a plurality of at least ten adjacent coupling elements along a stringer have a delta E* of at least one, more preferably five, and most preferably ten, wherein E* represents the total color measurement of the color of a coupling element, combining the color coordinates L*, a*, and b*; wherein L* is a measure of the lightness and darkness of the color; a* is a measure of the redness or greenness of the color; and b* is a measure of the yellowness or blueness of the color. Coupling elements may also be distinguished by providing variable coupling element areas, or by providing adjacent coupling elements having varying reflective properties. When coupling areas are varied, the coupling element projected areas should vary by at least 1%, and preferably by at least 5%. Variations in color, reflectivity and area may be used in any combination as desired, along with variable pitch, for enhanced or distinctive aesthetics, to code information, and/or to provide for trademark, copyright or trade dress protection for the garment or other article incorporating the zipper, thereby providing greater protection against copying and counterfeiting. As with paper currency, combinations of one or more different variations such as pitch, color, reflectivity, and coupling element face area are synergistic for security as, when used together, they greatly increase the difficulty in the manufacturing of imitations and counterfeits.

The following terms are defined as follows:

"Color" is taken to mean any color, including black, white and gray, and the phrase "distinguishable colors" means any two colors that are distinguishable by the human eye, and preferably exhibit a delta E* of at least one, more preferably five, and most preferably ten. Colors include those produced by any pigment or dye, and those that may be accentuated by UV light, such as fluorescent or phosphorescent pigments or dyes.

"Coupling element" means a substantially rigid projection (tooth), independently arrayed along a tape in a spaced fashion with other substantially rigid projections to form a stringer, the rigid projection having surface geometry for reversible mechanical interlocking with mating surface geometry of two adjacent projections on a mating stringer.

"Coupling element projected area" means the total area bounded by the outline of the face of a coupling element when projected perpendicularly upon the zipper plane when the zipper stringer is parallel to the zipper plane.

Delta E* is the absolute difference in E* between two overall colors of two coupling elements, where $E^*=((L^*)^2+(a^*)^2+(b^*)^2)^{1/2}$.

"Height" for a coupling element means, relative to the coupling element head (the portion of the coupling element with interlocking geometry), the distance from the proximal edge of the stringer tape to the distal edge of the coupling element. The height is measured in a direction perpendicular to the pitch line. "Face height" is the height of the coupling element above the stringer tape (generally towards the outside of a garment, bag, or other item), while "back height" is the height of the coupling element below the stringer tape.

"Information sequence" means the consecutive listing of one or more properties (such as pitch, color, reflectivity, or projected coupling area) that vary along the stringer or closed zipper.

"Pitch width", and also "coupling element spacing", means the distance along the pitch line and between the centerline of a coupling element to the centerline of the next adjacent coupling element on the same stringer.

"Pitch line" means the line that bisects the coupling elements of a closed zipper.

"Pitch sequence" means the consecutive listing of the coupling element widths of a stringer or zipper when closed.

"Reversible" means that the zipper or a segment thereof may be repeatedly closed and opened without damage to the coupling elements, except for normal wear.

"Self-interlocked" means that single coupling elements on one stringer are geometrically locked to two adjacent coupling elements on a mating stringer without the use of pins or other additional elements.

"Slider" means a moveable element for reversibly joining two stringers. Generally, a slider comprises a pair of converging channels for reversibly directing the two arrays of non-interlocked coupling elements of the stringers through a curved coupling path and into a parallel self-interlocked relationship. The use and construction of sliders is well known to those versed in the art.

"Stringer" means a flexible zipper half comprising a linear array of coupling elements independently and flexibly mounted to a tape, capable of coupling to a second stringer (e.g., by means of a slider, whereby the coupling elements on the stringers are temporarily rotated to allow them to be interleaved, then straightened to geometrically interlock them with adjacent mating coupling elements).

"Tape" means the cord and/or strip to which coupling elements are flexibly arrayed to form a stringer.

"Width" of a coupling element is measured along the pitch line of the zipper, and is herein equal to one half of the coupling element spacing of a closed zipper having identical coupling elements.

"Zipper" means two mating stringers, coupled or aligned for coupling.

"Zipper assembly" means a zipper comprising a slider.

"Zipper plane" means the plane that is parallel to the zipper when the zipper is closed and flat (planar).

In a preferred embodiment, a stringer comprises a first plurality of coupling elements having a first color, and a second plurality of coupling elements having a second color distinguishable from the first. The first and second plurality of coupling elements are preferably interspersed along at least 50% of the coupled length of the stringer. This means that they alternate from time to time over this distance—preferably at least ten times. Although any number of different colors may be used, two are preferred. In combination with distinguishable colors, the visible surfaces of the coupling elements of the zipper may be varied to produce varying reflectivities. As may be appreciated, reflectivity may be used to alter or enhance the color effects, and may be used alone. Reflectivity may be altered by varying the surface characteristics of adjacent coupling elements. For instance, matt and specular surfaces may be used in a sequence, with or without actual color differences. Prismatic or other textured surfaces may be molded into the coupling elements to enhance or diminish reflective effects at particular angles. Also, different holographic patterns may be molded into the coupling element surfaces. As it is easier to alter mold surfaces that it is to provide individualized colors, each of the coupling elements could be provided with an individualized reflectivity different from all of the others, if desired. In any case, two or more different reflectivities are provided and are alternated as described above with reference to variable color.

In another preferred embodiment, a stringer comprises coupling elements having variable gap and/or pitch. In this embodiment, the stringer comprises at least two different gaps and/or at least two different pitches. Varying gaps/pitches may be used alone, or in any combination with color and/or reflectivity differences. As may be appreciated, color and reflectivity differences may be used to enhance other visual differences, such as those obtained by varying the gap and/or pitch. Varying gap and/or pitch may be used to create noise and vibration that are sensed by the user, adding a tactile sensation to the visual aesthetic character of the zipper.

The coupling elements may be metallic or polymeric, but are preferably molded from thermoplastic materials. A zipper may be individually molded as discreet stringers, or more efficiently by continuous injection molding on a mold wheel with one or more mold bands. Such a manufacturing method is described in U.S. Pat. Nos. 4,268,474 and 4,350,656 to Moertel, the teachings therein entirely incorporated herein by reference. The surface geometry that interlocks a given coupling element with adjacent coupling elements may comprise male and female projections that prevent relative movement in both the zipper plane and in the direction orthogonal to the zipper plane. Alternatively, mating projections may be used to prevent movement in the zipper plane, with separate projections to prevent motion orthogonal to the plane. Known modifications such as end stops and/or pin members (for aligning a slider and the ends of two mating stringers) can be provided at the ends of the stringers.

It is an object of the present invention, therefore, to provide a zipper having improved visual aesthetics.

It is another object of at least one embodiment of the invention to provide a zipper having improved tactile and aural aesthetics when opened and closed.

It is another object of at least one embodiment of the invention to provide a zipper having a variable appearance.

It is another object of at least one embodiment of the invention to provide a zipper having information coded in a sequence of coupling elements.

It is another object of at least one embodiment of the invention to provide a garment or other article incorporating a zipper having a variable appearance, thereby providing protection against copying and counterfeiting for the parent garment or article.

BRIEF DESCRIPTION OF THE DRAWINGS

The above as well as other objects of the invention will become more apparent from the following detailed description of the preferred embodiments of the invention, when taken together with the accompanying drawings in which:

FIG. 1 is a plan view of a partially closed zipper segment according to one embodiment of the invention.

FIG. 2 is a plan view of a portion of the zipper segment shown in FIG. 1.

FIG. 3 is a plan view of partially closed zipper segment according to one embodiment of the invention.

FIG. 4 is a plan view of two uncoupled complementary stringer segments.

FIG. 8A is a front elevation of a slider for coupling stringers having variable face heights.

FIG. 8B is a plan sectional view taken along line 8B—8B of the slider shown in FIG. 8A.

FIG. 9A is a side elevation of a coupling element having an extended face height relative to the base height.

FIG. 9B is a side elevation of a coupling element having an extended face height and light reflecting grooves.

FIG. 9C is a side elevation of a coupling element having an extended face height, light reflecting grooves, and a guide tab.

FIG. 10A is a plan view of a pair of molded stringer segments, in couplable alignment.

FIG. 10B is a plan view of a pair of molded stringer segments, with perpendicular runners joining the centers of the coupling elements.

FIG. 10C is a plan view of a pair of molded stringer segments, with equally spaced perpendicular runners joining the coupling elements.

FIG. 11 is a plan view of a coupled double pair of the molded stringer segments shown in FIGS. 10A–10C.

DETAILED DESCRIPTION OF THE PRESENTLY PREFERRED EMBODIMENTS

Figure 5:
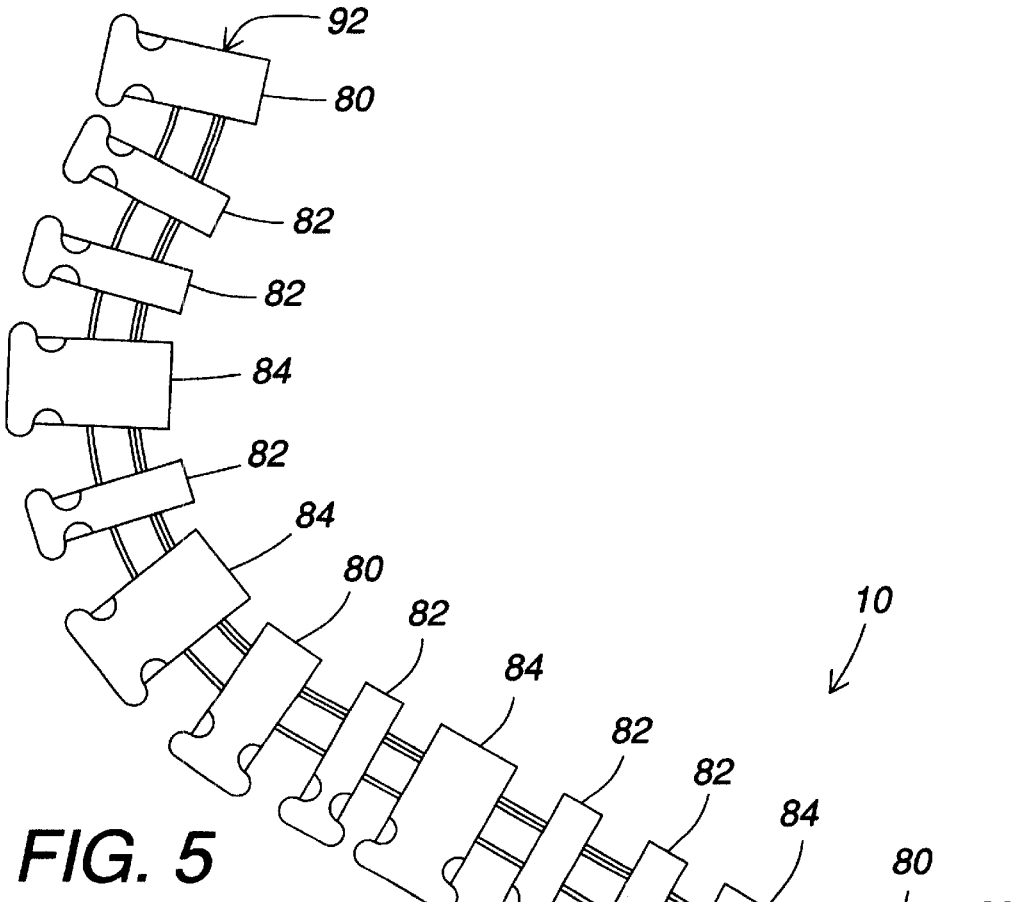
FIG. 5 is a plan view of a segment of a stringer carrying coded information.

Referring now to the drawings wherein like numerals refer to like parts, FIG. 1 illustrates a partially closed zipper 2 comprised of left and right stringers 12, 14. Left stringer 12 is comprised of strip 30 attached to cord 34 that carries a plurality of coupling elements 36, 37 having different widths. Right stringer 14 is comprised of strip 28 attached to cord 32, carrying a plurality of coupling elements 40, 41 for interlocking with coupling elements 36, 37. A locking projection 38 extending from one side of coupling element 37 mates with recess 44 of coupling element 40 so as to substantially prevent relative motion of the elements. Locking projections for interlocking zipper elements are well known, e.g., as described in U.S. Pat. No. 1,219,881 to Sundback, the teachings of which are fully incorporated by reference.

In FIG. 2, a zipper segment 4 is shown to have five different spacings 46, 48, 50, 52 and 56. (Spacing 54 is equal to spacing 50.) Using coupling elements 16, 18 having only two widths provide a minimum of two and a maximum of five different spacings.

Turning now to FIG. 3, a partially closed zipper 6 is comprised of left and right stringers 20, 22. Left stringer 22 is comprised of strip 62, which is attached to cord 66 carrying coupling elements 68, 69. Right stringer 22 is comprised of strip 60 attached to cord 64 that carries coupling elements 74, 75. Coupling elements 69, 74 have the same width, as do coupling elements 68, 75. As shown, the individual elements of coupling element pairs 69, 74 and 68, 75 are identical, but are rotated 180 degrees. However, they need not be identical so long as they are capable of interlocking. The pitch sequence of zipper 6 is the same as the pitch sequence of zipper 2 shown in FIG. 1, however the coupling elements use a different surface geometry for coupling with adjacent coupling elements. At the uncoupled end of zipper 6, ledge 72 of coupling element 68 will interlock with slot 73 in the upper surface of head 76 of coupling element 74. The side surfaces of head 76 mate with the recesses 71, and the side surfaces of head 70 mate with the recesses 77. Such interlocking geometry is described in U.S. Pat. No. 4,418,449 to Heimberger, et al., the teachings of which are entirely incorporated herein by reference. Similar geometry is described in U.S. Pat. No. 2,394,211 to Siff, the teachings of which are also incorporated by reference.

A pair of stringers 23, 25 comprise the open zipper 8 shown in FIG. 4. The left stringer 23 is comprised of cord 24 and spaced coupling elements 68, 74 having two different widths. The right stringer 25 is comprised of cord 26 and spaced coupling elements 74 having only a singe width.

The right stringer 10 shown in FIG. 5 has coupling elements 80, 82, 84 having three different widths. If, arbitrarily, the widest element 84 is interpreted as a space, the narrowest element 82 as a dot, and element of intermediate width 80 as a dash, then reading from stringer end 92, the stringer encrypts the word "denim" in Morse code.

Figure 6:
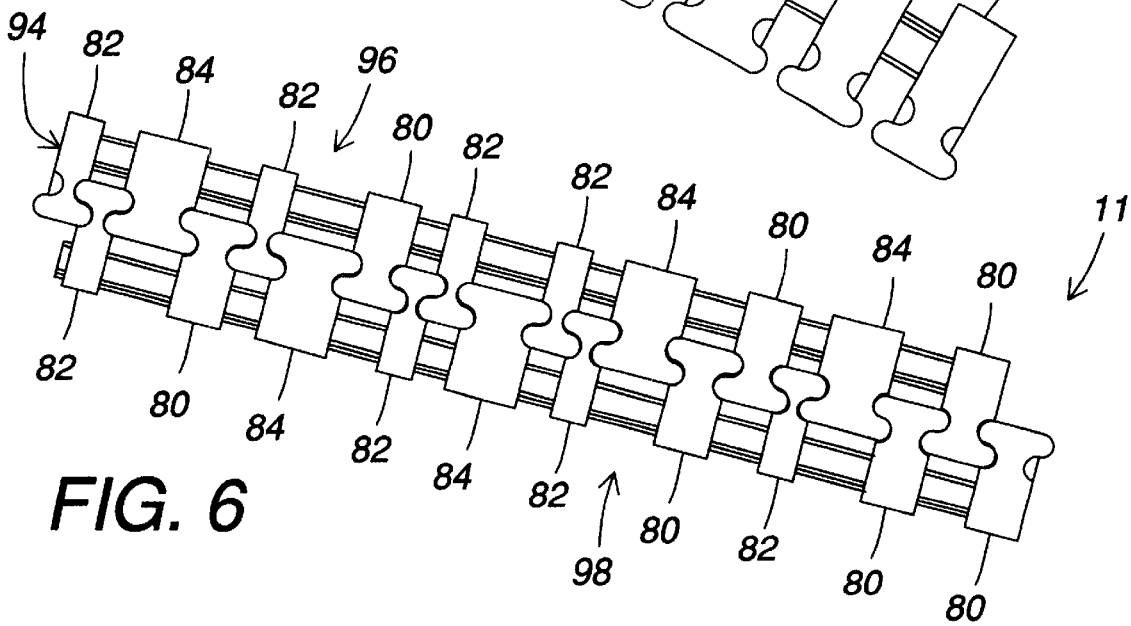
FIG. 6 is a plan view of a segment of a closed zipper carrying coded information.

In FIG. 6, the zipper pitch sequence starting from zipper end 94 is used to encode the word "indigo" in Morse code. The same meaning is given to the coupling elements 80, 82, 84 as in FIG. 4, except that the reading of zipper segment 11 starts at end 94 of stringer segment 96 and proceeds alternately between stringer segment 96 and stringer segment 98, so that all of the coupling elements in the zipper segment 11 are employed. Of course, the Morse code example used here is only one of many such coding systems that may be used within the scope of the present invention. Such patterned zippers, whether encrypting or not, are readily distinguished from plain zippers and, due to the higher cost of manufacturing molds for such special tooth arrangements, the cost of counterfeiting is increased, and thereby discouraged.

Figure 7A:
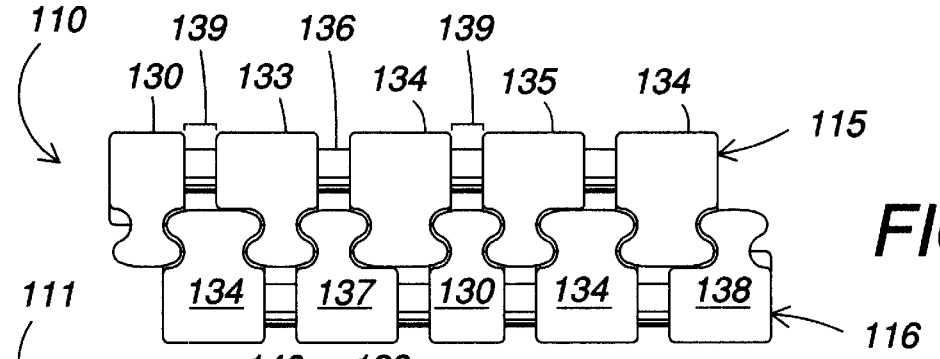
FIG. 7A is a plan view of a segment of a closed zipper having variable pitch and constant gap.
Figure 7B:
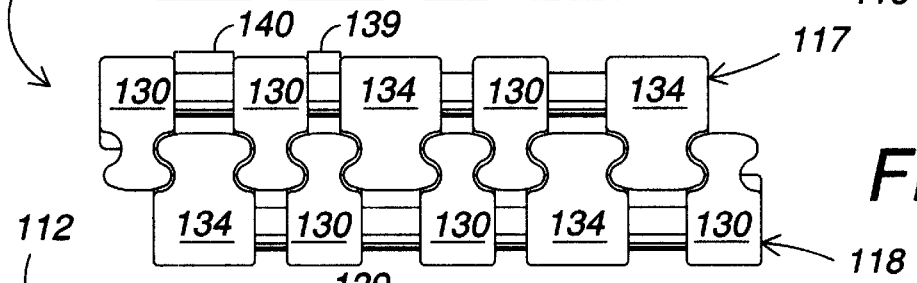
FIG. 7B is a plan view of a segment of a closed zipper having variable pitch and variable gap.
Figure 7C:
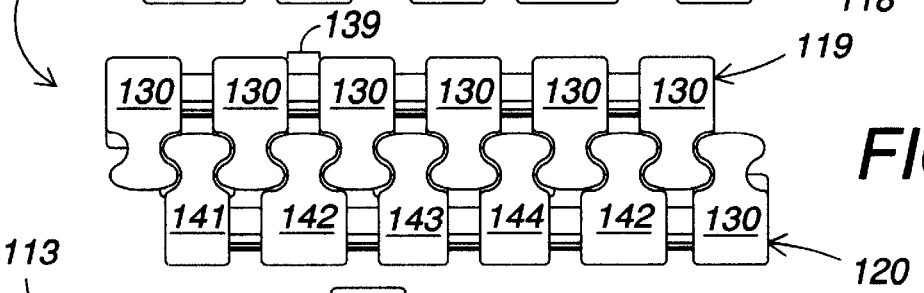
FIG. 7C is a plan view of a segment of a closed zipper having coupling elements having variable projected base widths, constant pitch and constant gap.
Figure 7D:
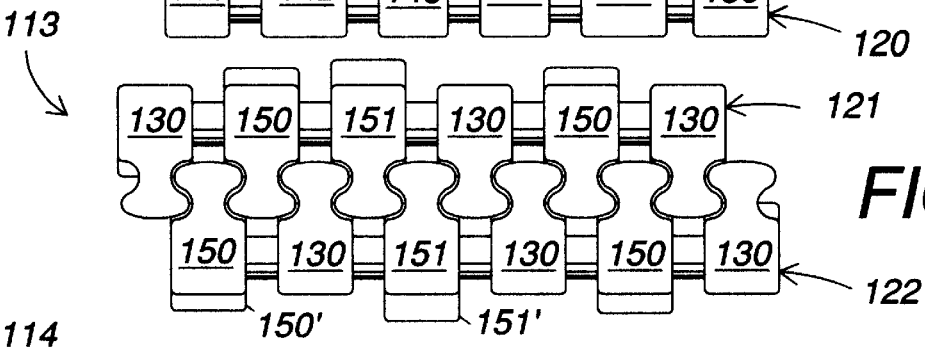
FIG. 7D is a plan view of a segment of a closed zipper having coupling elements having variable face heights, constant pitch and constant gap.

Turning now to FIGS. 7A–7E, several illustrative embodiments are shown wherein the visual appearance along the zipper may be varied. In FIG. 7A, a zipper segment 110 formed of stringer segments 115, 116 each comprise narrow coupling elements 130, wide coupling elements 134, and offset coupling elements 133, 135, 137, 138 to achieve a variable pitch with constant coupling spacing 139. In FIG. 7B, a zipper segment 111 formed of stringer segments 117, 118 comprise narrow coupling elements 130 that are interspersed with wide coupling elements 134 to form a variable zipper with two spacings 139, 140. In FIG. 7C, a first stringer segment 119 having identical coupling elements 130 and constant spacing 139 is mated with a second stringer segment 120 to form variable zipper segment 113. Second stringer segment 120 comprises narrow coupling elements 130 and offset coupling elements 141–144 to give the stringer segment 120 and closed zipper segment 112 a subtle variable appearance. In FIG. 7D, zipper segment 113 is shown from the backside to be comprised of variable stringer segment 121 and variable stringer segment 122. Stringer segment 121 is comprised of narrow coupling elements 130 and coupling elements 150, 151 having extended face heights, while all of the coupling elements have a constant back height. (See also FIGS. 9A–C.)

Figure 7E:
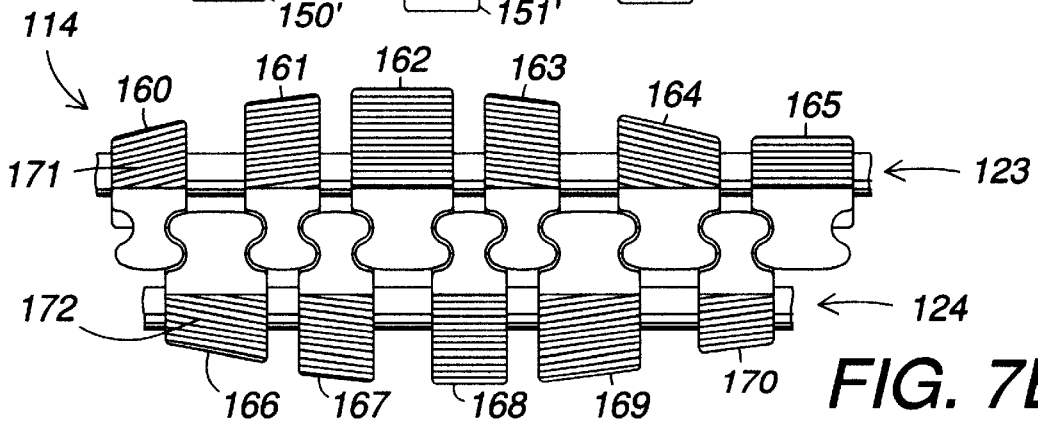
FIG. 7E is a plan view of a segment of a closed zipper segment having variable base height, constant pitch, constant gap, and variably oriented face grooves.

In FIG. 7E, the face side of zipper segment 114 is shown to comprise stringer segments 123, 124. Stringer segment 123 comprises coupling elements 160–165 having variable face heights and stringer segment 124 comprises coupling elements 166–170 having variable face heights interleaved and interlocked with coupling elements 160–165. The coupling elements are further differentiated by differing reflectivities resulting from grooves placed on the faces of the coupling elements at different orientations or angles. For instance, coupling element 160 comprises grooves 171 at approximately 15 degrees, and coupling element 166 comprises grooves 172 at approximately –15 degrees. Of course, any groove pattern or texture may be used to differentiate the coupling element reflectivity. The coupling elements may alternatively be differently patterned with curved grooves, different textures, and/or holographic imprinting, by way of example only. In any case, from a constant viewing angle relative to each coupling, the reflectivity is different.

Turning now to FIGS. 8A–B, a slider 200, moving in direction 240, is shown in the process of coupling stringer segments 215, 216. Stringer segments 215, 216 comprise coupling elements 213 having a first face height interspersed with coupling elements 212 having a second face height. Slider 200 comprises pull 241 and rear plate 201 joined to front plate 202 by post 209 to form channels 206, 208 that converge to form channel 207. Guides 204, 205 extending from rear plate 201 serve to guide the coupling elements by contact with the side of the coupling element back face 210 and head 211. The coupling element base face 214 and/or head 211 may contact the inside of front plate 202; however, the edge 203 of front plate 202 preferably does not comprise a lip in order that coupling elements having variable base face heights may pass through unhindered. A slider similar to the present slider 200 is taught in U.S. Pat. No. 2,095,270 to Silberman, the teachings of which are incorporated herein by reference. Slider 200 may also be used with any of the zipper embodiments herein, but is particularly suited for the embodiments shown in FIGS. 7D–E, 8, 9.

In FIGS. 9A–C, variations of the coupling elements shown in FIGS. 7D and 8A–B are shown. In FIG. 9A, coupling element 230 comprises groove 233 for interlocking with ledge 234 of an adjacent facing coupling element of a mating stringer, with back height 238 and face height 235. In FIG. 9B, the appearance of the coupling element 231 is modified by extending the face height 236 relative to the back height 238. Additionally, grooves 237 have been added to the coupling element face 236. In FIG. 9C, ridge 239 of coupling element 232 has been added for an additional guide surface, and which would be used with a slide having a complementary groove. In either case, the height is measured from the pitch line of the closed zipper. A symmetrical coupling element of the same type is shown in U.S. Pat. No. D252,896 to Jovin, and similar types in U.S. Pat. No. 4,040,150 to Fukuroi, and the teachings of both are incorporated herein by reference.

Coupling elements of the instant invention are preferably molded of a thermoplastic or thermoset material, and most preferably are continuously molded of a thermoplastic polymer. Exemplary apparatus and methods for continuous molding of stringers is taught in U.S. Pat. Nos. 4,182,600, 4,268,474 and 4,350,656, all to Moertel, the teachings of which are herein incorporated by reference.

Turning now to FIGS. 10A–C, variable stringer segment 250 comprising coupling elements 252, 253 and spaces 254, 255 is shown variously joined to mating zipper stringer segment 251 by runners 257 punctuated by sprues 256. In FIG. 10A, stringer segments 250, 251 are in mating alignment with sprues 256 joining the heads of the facing coupling elements at gates 258. In FIG. 10B, sprues 257 join the centers of the heads of facing coupling elements, and stringer segment 251 is offset from stringer segment 250. In FIG. 10C, stringer segments 250 and 251 are offset, and sprues 257 are also offset to provide an even spacing of the sprues along the pitch direction.

In FIG. 11, two segments of stringer segment 250 are shown joined to two segment of stringer segment 251 to form zipper segment 259, after trimming of runners 257 and sprues 256.

Figure 12:
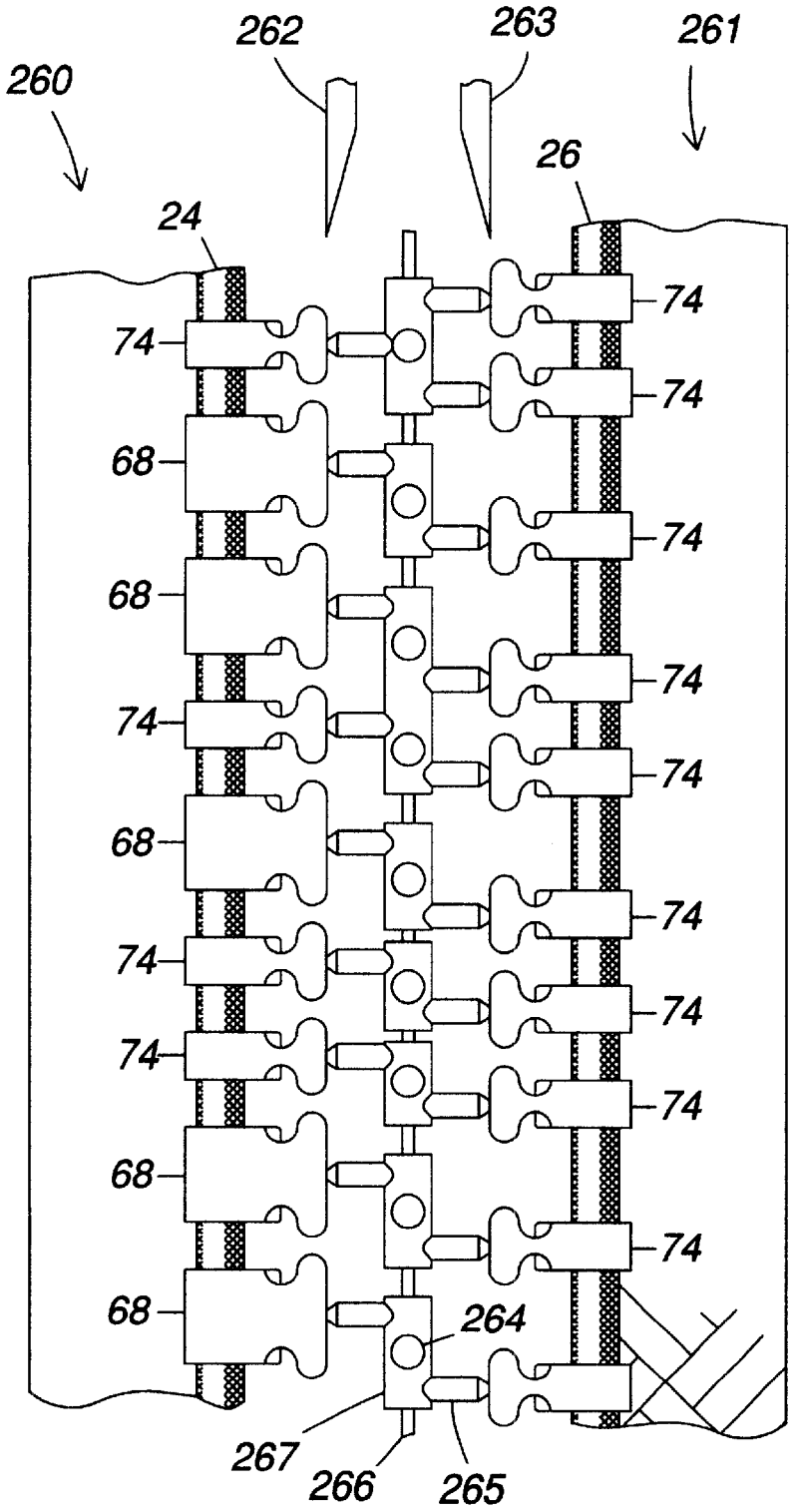
FIG. 12 is a plan view of a pair of molded stringer segments, in couplable alignment.
Figure 13:
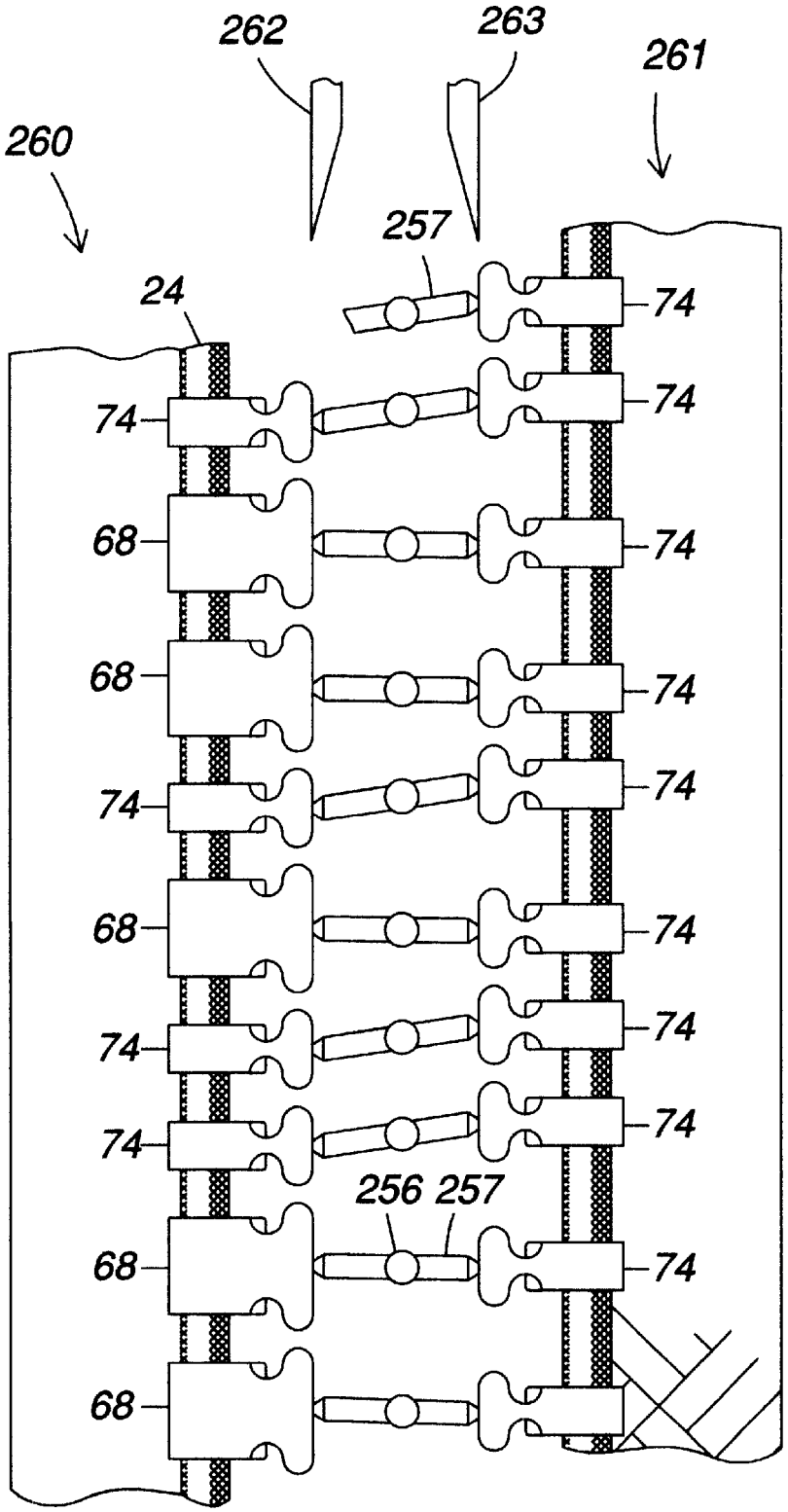
FIG. 13 is a plan view of a pair of molded stringer segments, with coupling elements joined by generally non-parallel runners.

Alternative arrangements of sprues and runners are shown in FIGS. 12 and 13. In FIG. 12, variable pitch stringer 260 comprises wide coupling elements 68 and narrow coupling elements 74, and mating variable pitch stringer 261 comprises only narrow coupling elements 74. The coupling elements are connected by runners 267 parallel to the pitch line feeding into runners 265 connected to the coupling elements. Sprues 264 are provided for connecting with the runners 267 and polymer injection means (not shown). A yarn 266 joins runners 267 so that they may be conveniently disposed of as a unit when trimmed from the stringers by blades 262, 263. Any appropriate means may be used for trimming, including rotating wheels as taught by Moertel in U.S. Pat. No. 4,182,600. Such teachings are incorporated herein by reference.

Figure 14A:
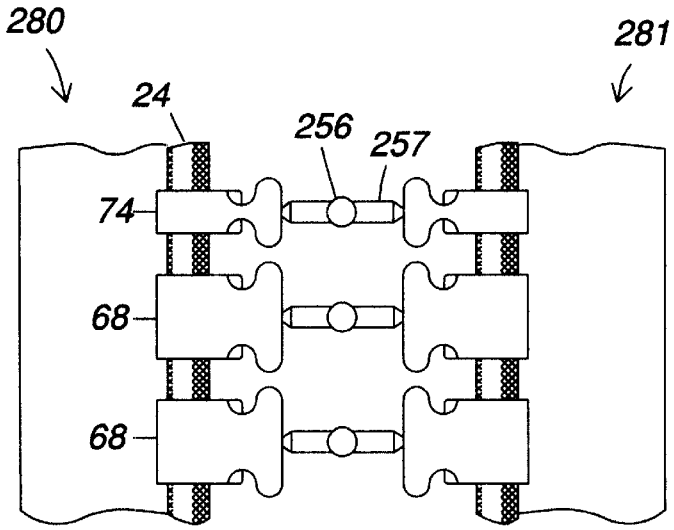
FIG. 14A is a plan view of a pair of molded stringer segments, with sprues centered on the runners.
Figure 14B:
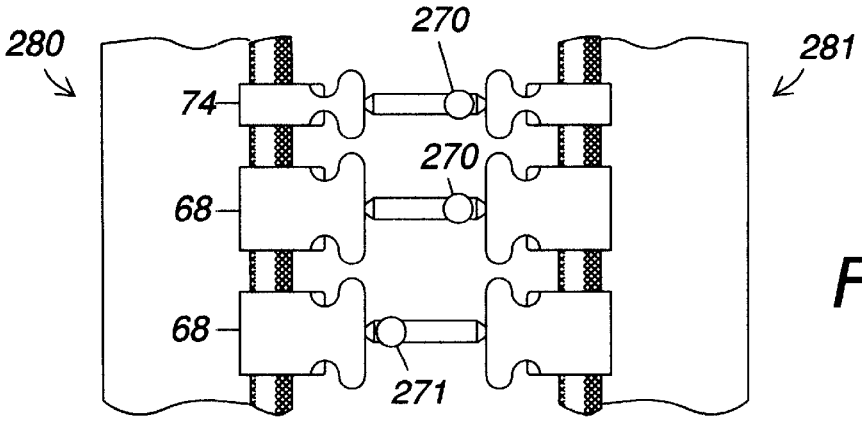
FIG. 14B is a plan view of a pair of molded stringer segments, with two parallel lines of sprues.
Figure 14C:
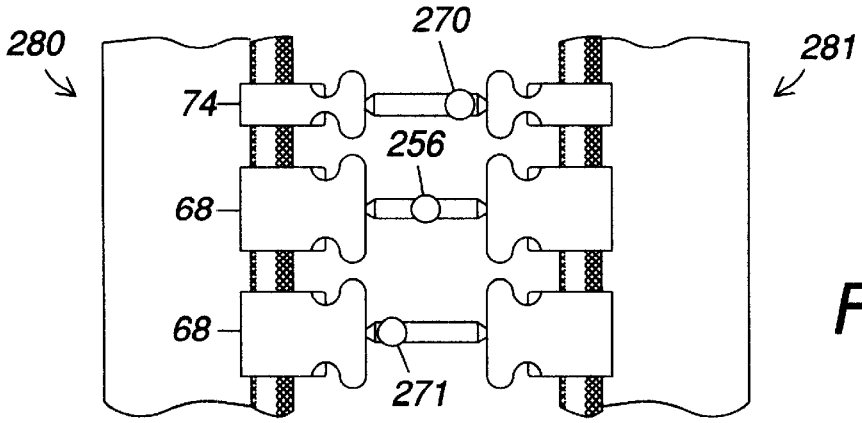
FIG. 14C is a plan view of a pair of molded stringer segments, with three parallel lines of sprues.

Variable colors may be introduced into the coupling elements of a stringer by the placement of sprues or by the relative placement of shoes relative to the sprues, or by the oscillation of injection pressure in a shoe. In FIGS. 14A–C, stringer segments 280, 281 are shown, joined by runners 257 having sprues 256. Sprues 256 may be aligned for the purpose of forming coupling elements 68, 74 of variable color. In FIG. 14A, sprues 256 are aligned in the pitch direction. In FIG. 14B, sprues 270, 271 form two lines in the pitch direction, and in FIG. 14C, the sprues 256, 270, 271 form three lines in the pitch direction. For stationary injection shoes, the arrangements shown in FIGS. 14A–C allow one, two, and three different coupling element colors; while, for variable injection, a plurality of colors can be created with a single line of sprues. Obviously, variable injection can be used also with sprues with a plurality of alignments, and a plurality of polymer sources having different visual or tactile characteristics can be used.

Figure 15A:
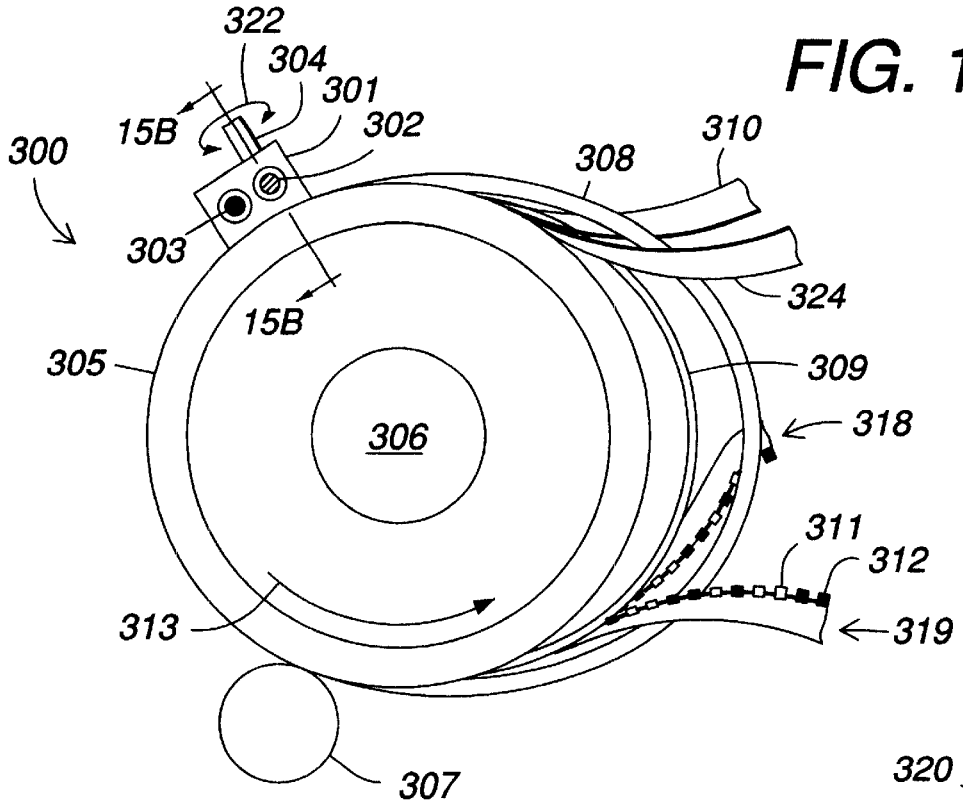
FIG. 15A is a side elevation of an apparatus for molding stringers according to one embodiment of the invention.
Figure 15B:
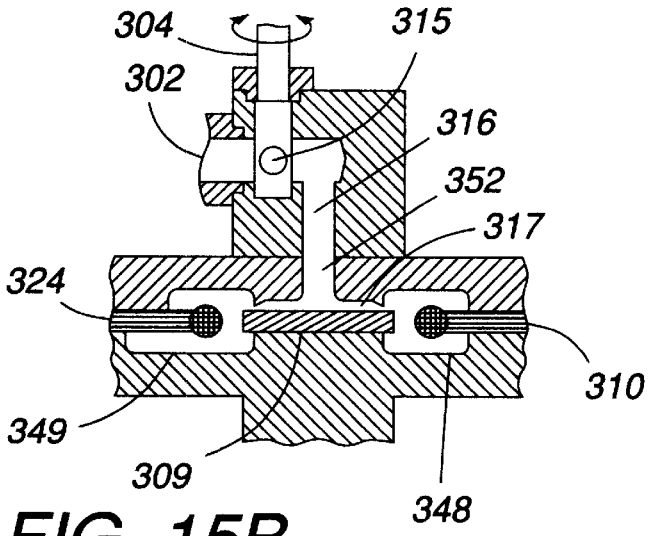
FIG. 15B is a front elevation in section taking along line 15B—15B of FIG. 15A.

Turning now to FIGS. 15A–B, a molding apparatus 300 usable to create variable stringers according to the instant invention is shown. A similar apparatus is taught in U.S. Pat. No. 4,350,656 to Moertel, the teachings of which are incorporated herein by reference. Moertel teaches the injection of a single polymer stream. In FIGS. 15A–B, provision is made for injection of two different polymer streams in a variable fashion in order to mold coupling elements 311, 312 onto tapes 310, 314 to form a pair of variable stringers 318, 319 using a single line of sprue cavities 352. In addition, the height of cavity face 349 is extended compared to height of cavity face 348. Varying surface textures may be applied to the surfaces of the cavity faces 348, 349 in order to add variations in reflectivity. Also, the spacing of the coupling elements may be varied to produce varying pitch.

In FIG. 15A, a motor (not shown) is used to drive mold wheel 305 via shaft 306 in direction 313. Band 309 and band 308 are brought into contact with the exterior surface of wheel 305 by injection shoe 301 and roller 307. Before bands 308, 309 contact wheel 305, tapes 310, 324 are inserted between band 308 and wheel 305, and stringers 318, 319 comprising coupling elements 311, 312 are removed after roller 307. Injection shoe 301 comprises ports 302, 303 for injection of two polymer streams having different characteristics, such as color, reflectivity, etc. Rotation or oscillation 322 of valve shaft 304 allows variable fluid flow from port 302. Turning now to FIG. 15B, a cross-segment taken along line 15B—15B of the injection shoe 301 and the periphery of wheel 305 is shown. When port 315 is closed by rotation of shaft 304, sprue cavities 256 not filled with polymer from port 302 are then subsequently filled by port 303 (FIG. 15A), which is open. So when port 315 is open, coupling elements are formed of polymer entering port 302, and when port 315 is closed, coupling elements are formed of polymer entering port 303. Therefore, a stringer having coupling elements having variable color, reflectivity, tactile and/or other properties along the length of the stringer may be formed. The particular sequence may be varied randomly or to a particular schedule, and a computer may be used to direct the rotation or oscillation of shaft 304 to obtain any particular sequence. Furthermore, more than two colors may be injected by use of more than two valved ports such as port 302.

Figure 16:
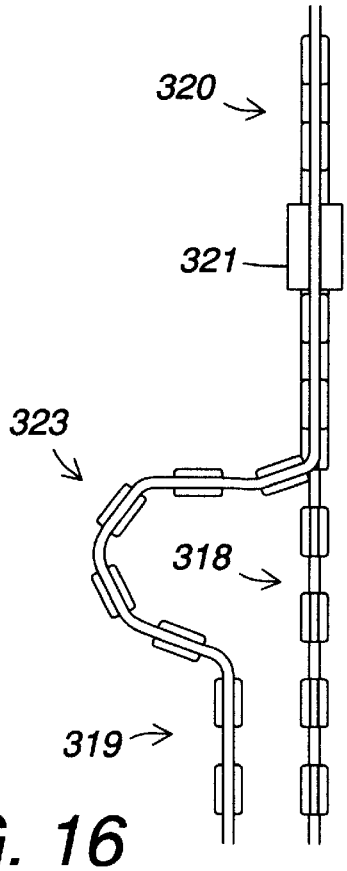
FIG. 16 is a diagramical side elevation showing the alignment of stringers to form a closed zipper.

In FIG. 16, stringers 318, 319 are shown entering coupling slider 321 to form coupled zipper 320. A loop 323 is provided in stringer 319 in order to properly align the sequences of the stringers for proper coupling. If the stringers do not vary in pitch, they may be coupled with any alignment; however, it is generally desirable to couple the stringers so that the variability in the closed zipper is controlled, e.g., so that variation along the pitch line of the closed zipper is maximized. When the stringers have variable pitch, it is necessary for coupling to orient the stringers so that one stringer pitch sequence complements the other.

Figure 17:
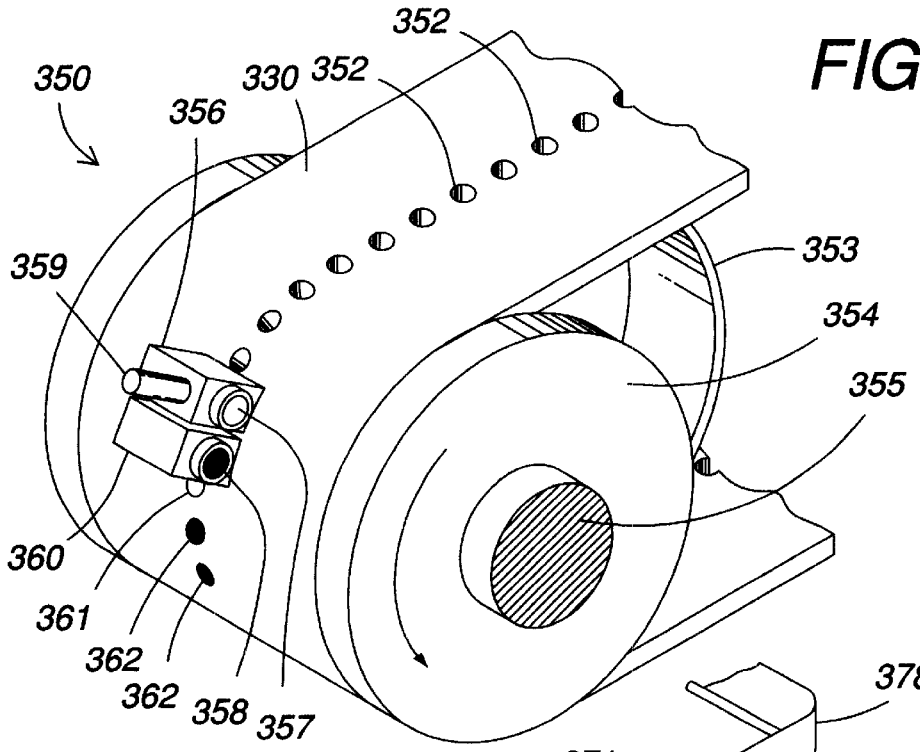
FIG. 17 is a perspective view of a portion of an apparatus for molding stringers according to one embodiment of the invention.

Turning now to FIG. 17, a section of a molding apparatus 350 similar to that in FIG. 15A is shown. Molding wheel 354 driven by shaft 363 is partially enclosed by band 353 and molding band 330, comprising a single line of empty sprue cavities 352. Injection shoes 360, 356 are fed with polymer via ports 358, 357 respectively. The flow through port 357 into sprue cavities 352 can be interrupted by rotation of shaft 359. For example, sprue cavity 361 has been filled with polymer from injection shoe 356, while sprue cavities 362 have been filled with polymer from injection shoe 360.

Figure 18:
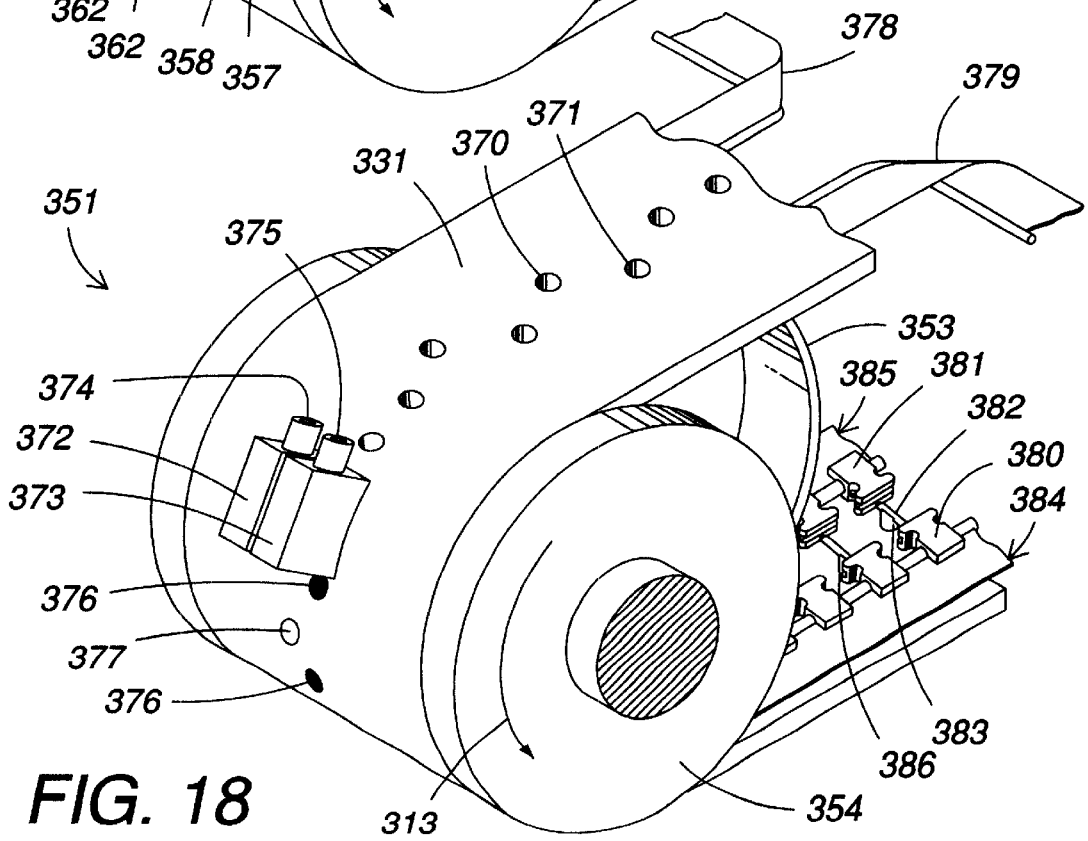
FIG. 18 is a perspective view of a portion of an apparatus for molding stringers according to one embodiment of the invention.

In FIG. 18, a section of an alternative molding apparatus 351 to that of FIG. 17 is shown. Molding wheel 354 turns in direction 313, driven by a motor (not shown) via shaft 355, and is partially enclosed by band 353 and molding band 331. Molding band 331 comprises two lines of empty sprue cavities 370, 371 that are filled by a pair of injection shoes 372, 373 fed by ports 374, 375 respectively to form filled sprue cavities 376, 377 (as well as underlying runners and coupling elements). Tapes 378, 379 are inserted between molding band 331 and molding wheel 354 and exit as stringers 385, 384 comprising molded coupling elements 381, 380 joined by runners 382 having sprues 383, 386.

Figure 19:
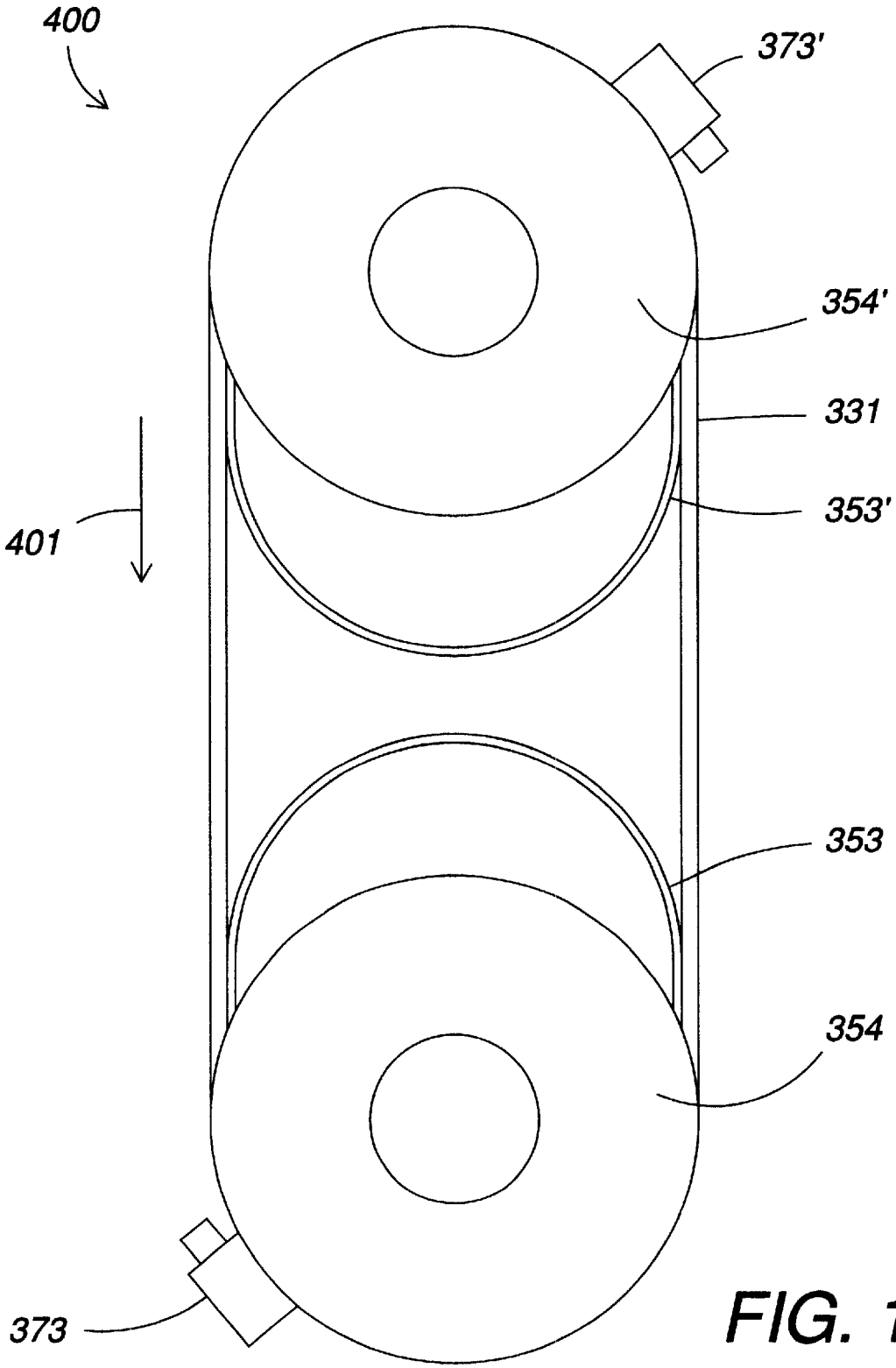
FIG. 19 is a side elevation of the apparatus shown in FIG. 18.
Figure 20:
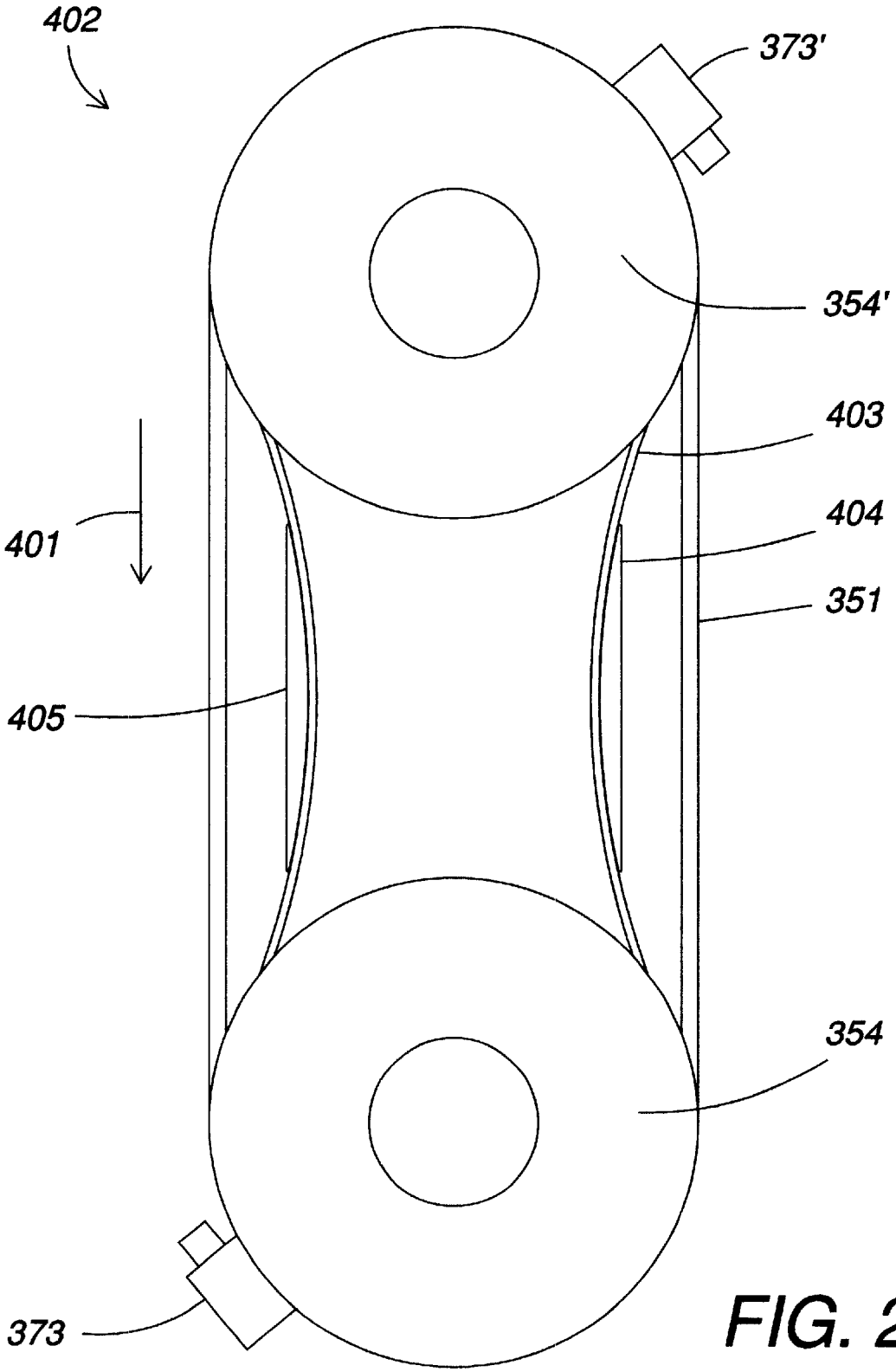
FIG. 20 is a side elevation of an alternative configuration of the apparatus shown in FIG. 19.

The apparatus section 351 shown in FIG. 18 may represent half of molding apparatus 400 shown in FIG. 19. A pair of molding wheels 354, 354' are bounded individually by a pair of bands 353', 353, and bounded by a single molding band 331. In forming stringers, the molding band 331 moves in direction 401, with polymer delivered by injections shoes 373, 373', as well as other by other injection shoes as shown in FIG. 18. Alternatively, injection shoes such as those shown in FIG. 17 or FIG. 15 may be used. Another variation is shown in FIG. 20, where, in molding apparatus 402, the bands 353', 353 of FIG. 19 are replaced by a single band 403 that is tensioned and spread apart from molding band 351 by a pair of guides 404, 405.

Although only a few exemplary embodiments of this invention have been described in detail above, those skilled in the art will readily appreciate that many modifications are possible in the exemplary embodiments without materially departing from the novel teachings and advantages of this invention. In particular, it is to be understood that any zippers and zipper stringers comprising coupling elements comprising any self-interlocking geometry are within the scope of this invention. Accordingly, all such modifications, including locking geometry, are intended to be included within the scope of this invention as defined in the following claims. In the claims, means-plus-function clauses are intended to cover the structures described herein as performing the recited function and not only structural equivalents, but also equivalent structures.

I claim:

1. A zipper, comprising:

a first stringer comprising a first plurality of coupling elements independently projecting from a first tape; a second stringer comprising a second plurality of coupling elements independently projecting from a second tape; and a slider;

wherein said first plurality of coupling elements are reversibly interleavable and fully self-interlockable with said second plurality of coupling elements by said slider to form a fully coupled zipper section;

wherein said first plurality of coupling elements comprise at least ten visually distinguishable pairs of adjacent coupling elements; and wherein said distinguishable pairs of adjacent coupling elements carry coded information.

2. A zipper as recited in claim 1, wherein said distinguishable pairs of adjacent coupling elements comprise at least two different coupling element colors.

3. A zipper as recited in claim 2, wherein said two different coupling element colors exhibit a delta E* of at least one.

4. A zipper as recited in claim 2, wherein said two different coupling element colors exhibit a delta E* of at least five.

5. A zipper as recited in claim 2, wherein said two different coupling element colors exhibit a delta E* of at least ten.

6. A zipper as recited in claims 2, wherein said first plurality of coupling elements comprise varying coupling element spacing.

7. A zipper as recited in claim 2, wherein said visually distinguishable pairs of adjacent coupling elements comprise at least two different coupling element reflectivities.

8. A zipper as recited in claim 2, wherein said visually distinguishable pairs of adjacent coupling elements comprise at least two different coupling element projected areas.

9. A zipper as recited in claim 2, wherein said visually distinguishable pairs of adjacent coupling elements comprise at least two different coupling element projected areas.

10. A zipper as recited in claim 1, wherein said visually distinguishable coupling elements are distinguishable under ultraviolet light.

11. A zipper as recited in claim 10, wherein said visually distinguishable coupling elements comprise fluorescent or phosphorescent pigments or dyes.

12. A zipper as recited in claim 1, wherein said visually distinguishable pairs of adjacent coupling elements comprise at least two different coupling element reflectivities.

13. A zipper as recited in claim 12, wherein said visually distinguishable pairs of adjacent coupling elements comprise varying surface texture.

14. A zipper as recited in claim 13, wherein said varying surface texture comprises grooves.

15. A zipper as recited in claim 12, wherein said first plurality of coupling elements comprise a varying coupling element spacing.

16. A zipper as recited in claim 12, wherein said visually distinguishable pairs of adjacent coupling elements comprise at least two different coupling element projected areas.

17. A zipper as recited in claim 12, further comprising a garment.

18. A zipper as recited in claim 1, wherein said visually distinguishable pairs of adjacent coupling elements comprise at least two different coupling element projected areas.

19. A zipper as recited in claim 18, wherein said visually distinguishable pairs of adjacent coupling elements comprise at least two different coupling element face heights.

20. A zipper as recited in claim 18, wherein said first plurality of coupling elements comprise varying coupling element spacing.

21. A zipper as recited in claim 18, further comprising a garment.

22. A zipper as recited in claim 1, further comprising a garment.

23. A zipper, comprising:

a first stringer comprising a first plurality of coupling elements independently projecting from a first tape; a second stringer comprising a second plurality of coupling elements independently projecting from a second tape; and a slider;

wherein said first plurality of coupling elements are reversibly interleavable and fully self-interlockable with said second plurality of coupling elements by said slider to form a fully coupled zipper section;

wherein said first plurality of coupling elements comprise at least ten visually distinguishable pairs of adjacent coupling elements;

wherein said visually distinguishable pairs of adjacent coupling elements comprise at least two visually distinct surfaces; and wherein said at least two visually distinct surfaces are molded into said visually distinguishable pairs of adjacent coupling elements; has wherein said at least two visually distinct surfaces comprise at least one from the group of varying prismatic surfaces, varying grooves, varying holographic patters, and varying projected coupling element areas;

whereby the visual appearance of said fully coupled zipper section is variable.

24. A zipper as recited in claim further comprising a garment.

* * * * *